US011179740B2

(12) United States Patent
Carta et al.

(10) Patent No.: US 11,179,740 B2
(45) Date of Patent: Nov. 23, 2021

(54) DISPENSER FOR DISPENSING A FLUID

(71) Applicant: APTAR ITALIA S.p.A., San Giovanni Teatino (IT)

(72) Inventors: Lamberto Carta, Pescara (IT); Andrea Colanardi, Faeto (IT)

(73) Assignee: APTAR ITALIA S.P.A., San Giovanni Teatino (IT)

( * ) Notice: Subject to any disclaimer, the term of this patent is extended or adjusted under 35 U.S.C. 154(b) by 0 days.

(21) Appl. No.: 17/261,306

(22) PCT Filed: May 24, 2019

(86) PCT No.: PCT/IB2019/054325

§ 371 (c)(1),
(2) Date: Jan. 19, 2021

(87) PCT Pub. No.: WO2020/026043

PCT Pub. Date: Feb. 6, 2020

(65) Prior Publication Data

US 2021/0323013 A1 Oct. 21, 2021

(30) Foreign Application Priority Data

Jul. 31, 2018 (IT) ..... 102018000007700

(51) Int. Cl.
*B05B 11/00* (2006.01)

(52) U.S. Cl.
CPC ..... *B05B 11/306* (2013.01); *B05B 11/3047* (2013.01); *B05B 11/3074* (2013.01)

(58) Field of Classification Search
CPC ..... B05B 11/306; B05B 11/3074; B05B 11/3047
See application file for complete search history.

(56) References Cited

U.S. PATENT DOCUMENTS 4,369,899 A * 1/1983 Magers ..... B67D 7/0211 222/153.13
4,589,574 A * 5/1986 Foster ..... B05B 11/306 222/153.13

(Continued)

FOREIGN PATENT DOCUMENTS

DE 11 2014 006 531 12/2016

OTHER PUBLICATIONS

International Search Report for PCT/IB2019/054325 dated Sep. 4, 2019, 3 pages.

(Continued)

*Primary Examiner* — Donnell A Long
(74) *Attorney, Agent, or Firm* — Nixon & Vanderhye

(57) ABSTRACT

A fluid dispenser includes a ring nut to be screwed on a bottle neck and including a shoulder and a collar extending in elevation from the shoulder. It also includes a dispensing head including a central portion, a spout designed to dispense the fluid contained in the bottle and a protective skirt extending to contain the collar of the ring nut. The protective skirt extends close to a peripheral portion of the shoulder and, in a closed configuration of the dispenser, has a safety distance from the shoulder. The dispensing head includes a cylindrical crown shaped to form a toothed profile and located between the protective skirt and the central portion. The ring nut collar includes gripping elements with a longitudinal extension and the toothed profile engages the gripping elements when closed. The toothed profile and the gripping elements are shaped to allow reciprocal rotation of the dispensing head.

20 Claims, 4 Drawing Sheets

(56) References Cited

U.S. PATENT DOCUMENTS

| | | | | |
|---|---|---|---|---|
| 5,615,806 | A * | 4/1997 | Grothoff | B05B 11/3023 222/153.13 |
| 6,695,171 | B2 * | 2/2004 | Walters | B05B 11/3059 222/153.13 |
| 7,757,897 | B2 * | 7/2010 | Young | B05B 11/3001 222/153.13 |
| 8,528,788 | B2 * | 9/2013 | Hummel | B05B 11/0029 222/153.13 |
| 2005/0173461 | A1 * | 8/2005 | Law | B05B 11/306 222/321.9 |
| 2007/0080174 | A1 * | 4/2007 | Coe | B05B 11/3059 222/153.13 |
| 2008/0190960 | A1 * | 8/2008 | Pfannhauser | B05B 11/3074 222/153.13 |
| 2008/0251537 | A1 | 10/2008 | Kuo | |
| 2017/0128966 | A1 * | 5/2017 | Law | B05B 11/3047 |
| 2018/0148236 | A1 * | 5/2018 | Flood | B65D 45/02 |
| 2019/0009291 | A1 * | 1/2019 | Santagiuliana | B05B 11/3047 |
| 2019/0015860 | A1 * | 1/2019 | Arminak | B05B 11/306 |
| 2019/0118205 | A1 * | 4/2019 | Knight | B05B 11/3074 |
| 2019/0183099 | A1 * | 6/2019 | Lin | F04D 29/601 |
| 2020/0139391 | A1 * | 5/2020 | Knight | B05B 11/3001 |

OTHER PUBLICATIONS

Written Opinion of the ISA for PCT/IB2019/054325 dated Sep. 4, 2019, 5 pages.

* cited by examiner

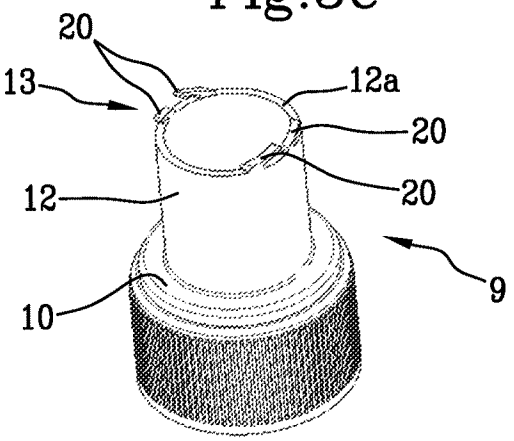
Fig.5c
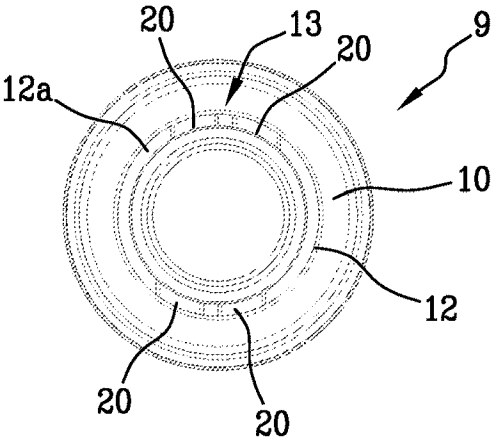
Fig.5b
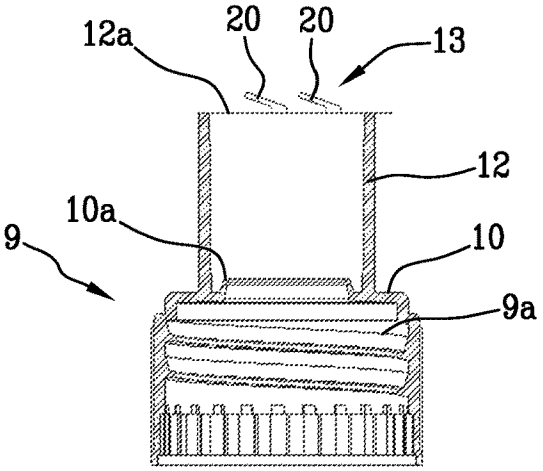
Fig.5a
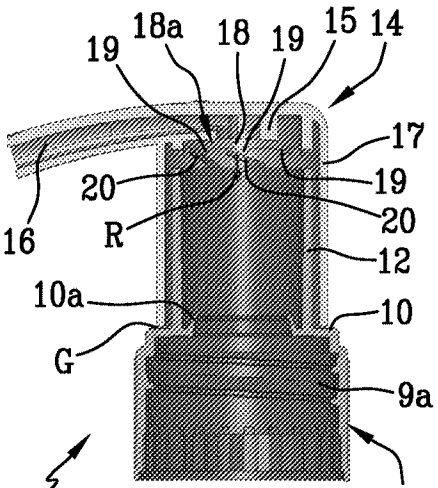
Fig.6dc
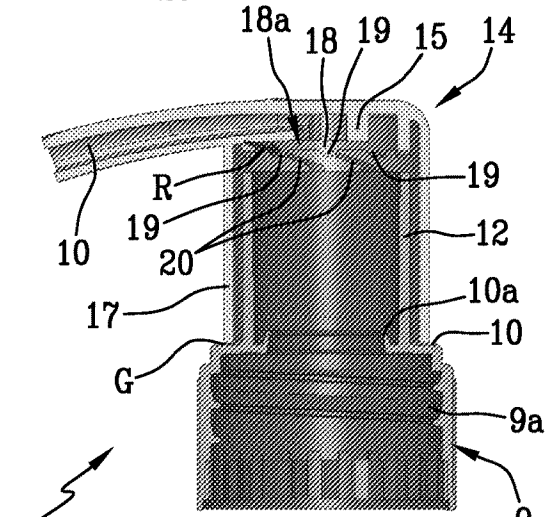
Fig.6c
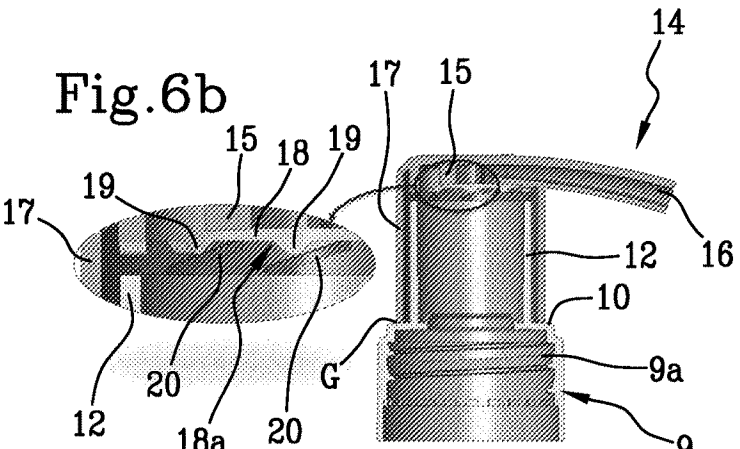
Fig.6a
Fig.6b

DISPENSER FOR DISPENSING A FLUID

BACKGROUND OF THE INVENTION

Field of the Invention

This invention relates to a dispenser for dispensing a fluid, that is to say, a dispensing device applicable to the neck of a bottle in order to dispense the fluid contained in the bottle.

Description of the Related Art

As is known, a dispenser is commonly used for dispensing liquid, such as, for example soap (or other product not explicitly mentioned below).

The liquid is contained in a bottle with which the dispenser is associated by means of suitable connecting means.

The dispensers on the market comprise an internal mechanism which allows the dispenser to be locked when it is in a non-operating condition. In particular, the known mechanisms comprise a control by means of a rotation for closing the dispensing head (or spout). The activation of the above-mentioned locking mechanisms makes it possible to avoid undesired activations, which may occur accidentally.

It is known that these locking mechanisms can be activated, respectively, with the dispensing head (or the spout) of the dispenser in a raised rest position or with the dispensing head (or the spout) in the lowered end of stroke position.

The dispensers having mechanisms activated with the dispensing head (or spout) in the raised position are known as 'lock-up dispensers' and offer the possibility of re-closing the dispenser after each use without having to activate it and thus be forced to dispense the liquid (which would therefore be wasted).

The dispensers having mechanisms activated with the dispensing head (or spout) in the lowered end of stroke position are known as 'lock-down dispensers' and provide dispensers with reduced dimensions in the steps prior to their use by a user. In other words, the dispensers have reduced dimensions when packaged for transport.

There are also mechanisms which allow the locking of the dispenser in both positions described above.

The prior art dispensers have fundamental requirements such as precision and repeatability of the volume of liquid dispensed or other requirements of an ergonomic or mechanical type.

The prior art dispensers having these mechanisms need to guarantee the sealing of the package, in particular when in the locked position.

Moreover, the prior art mechanisms need to withstand mechanical stresses, such as loads applied or impacts, which may be produced during transport or use of the packages to which the dispensers are associated.

These requirements have recently adopted a particular importance both as a function of the size and weight of the packages, and due to the transport and distribution conditions. In particular, with the increasing growth of the e-commerce sector, it has become necessary that these dispensers are easily portable in any condition.

Disadvantageously, the prior art dispensers are not able to withstand the loads applied by other external objects in contact with them during transport, or do not have the features needed to withstand an impact in the case of falling.

For this reason, the prior art dispensers art are not suitable for a safe transport since they are not able to withstand critical conditions such as those linked to falling and/or flattening, thereby annulling the above-mentioned requirements. In other words, the prior art dispensers are not able to withstand the high mechanical stresses, thereby resulting in involuntary breakage and/or unlocking with consequent loss of the product contained in the bottle.

SUMMARY OF THE INVENTION

The technical purpose of the invention is therefore to provide a dispenser for dispensing a fluid which is able to overcome the drawbacks of the prior art.

An aim of the invention is to provide a dispenser for dispensing a fluid which is particularly resistant to high mechanical stresses.

A further aim of the invention is to provide a dispenser for dispensing a fluid which avoids accidental openings of the dispenser even under very difficult transport conditions.

Another aim of the invention is to provide a dispenser for dispensing a fluid the external components of which are resistant to impacts.

Consequently, an aim of the invention is to provide a dispenser for dispensing a fluid whose external components prevent the impact energy from being transferred to the internal parts of the dispenser.

The technical purpose indicated and the aims specified are substantially achieved by a dispenser for dispensing a fluid comprising the technical features described in one or more of the appended claims. The dependent claims can correspond to possible embodiments of the invention.

The invention describes a dispenser for dispensing a fluid comprising a hollow containment body, which can be inserted in a bottle, and comprising an orifice for sucking fluid from the bottle.

According to an aspect of the invention, the dispenser comprises a ring nut which can be screwed on the neck of the bottle and comprising a shoulder, covering and associated with a lip of the containment body, and a collar extending in elevation from the shoulder.

Preferably, the dispenser comprises a piston slidable inside the containment body between a raised position and a lowered position.

Preferably, the dispenser comprises a hollow stem axially slidable inside the containment body and associated below the piston.

According to an aspect of the invention, the dispenser comprises a dispensing head comprising a central portion connected to an upper portion of the hollow stem for controlling the activation of the piston, a spout designed to dispense the fluid contained in the bottle and a protective skirt extending in such a way as to contain the collar of the ring nut.

Preferably, the dispenser comprises a retaining ring integral with the containment body and inserted inside it for guiding the stem in its stroke inside the containment body.

Preferably, the retaining ring has an upper portion surrounded by the collar.

According to an aspect of the invention, the protective skirt extends close to the peripheral portion of the shoulder and, in a closed configuration of the dispenser in which the dispensing of the fluid is prevented, has a safety distance from the shoulder.

Advantageously, this feature makes it possible to prevent, in the case of accidental impacts of the dispenser, excessive deformations to the ring nut or other internal components which could result in their breakage.

According to another aspect of the invention, the dispensing head comprises a cylindrical crown shaped to form a toothed profile and located between the protective skirt and the central portion.

According to an aspect of the invention, the collar of the ring nut comprises gripping elements, even more preferably said gripping elements having a longitudinal extension.

Preferably, the toothed profile is engaged with the gripping elements in the closed configuration.

Preferably, the toothed profile and the gripping elements are shaped in such a way as to allow a facilitated reciprocal rotation of the dispensing head and of the ring nut long a closing direction of the dispenser.

Preferably, the toothed profile and the gripping elements are shaped in such a way as to obstruct an accidental reciprocal rotation of the dispensing head and of the ring nut along an opening direction of the dispenser.

Advantageously, these features make it possible to prevent accidental openings of the dispenser and therefore prevent undesired losses of the fluid contained in the bottle.

Preferably, the toothed profile has a predetermined number of teeth and the collar has a predetermined number of gripping elements different from the number of teeth and such that at least one gripping element is engaged with a tooth.

Preferably, the toothed profile and the gripping elements are shaped in such a way as to obtain angles of contact to allow the facilitated reciprocal rotation of the dispensing head and of the ring nut along the closing direction of the dispenser.

Preferably, the toothed profile has a predetermined number of teeth alternated with the same number of recesses. Even more preferably, the predetermined number of teeth is offset relative to a predetermined number of gripping elements.

Preferably, the teeth are formed by two sections, each having a relative inclination.

Preferably, the gripping elements are located in an upper portion of the collar and define a discontinuous surface.

Preferably, according to an aspect of the invention, the gripping elements are shaped, in a portion even more preferably facing towards the toothed profile, with an asymmetrical profile with a variable inclination.

Preferably, the toothed profile is directed towards a central portion of the dispensing head.

Preferably, the toothed profile has teeth bevelled in a lower portion of them and the longitudinal members have a rounding in an upper portion facing towards the toothed profile.

Preferably, according to one aspect of the invention, the gripping elements are made in the form of tabs.

Preferably, the tabs define, with a horizontal edge of an upper portion of the collar, an acute angle greater than 0° and less than 90°.

Preferably, the toothed profile has teeth facing towards a lower portion of the dispensing head in such a way that a tooth slides on a respective tab, in such a way as to allow the facilitated reciprocal rotation of the dispensing head and of the ring nut along the closing direction.

Preferably, the toothed profile has teeth facing towards a lower portion of the dispensing head in such a way that a tooth is locked by a respective tab in such a way as to obstruct the accidental reciprocal rotation of the dispensing head and of the ring nut along the opening direction of the dispenser.

Preferably, the protective skirt has a diameter having dimensions close to a diameter of extension of the shoulder.

Preferably, the protective skirt has a length such as to guarantee said safety distance in the closed configuration of the dispenser.

Preferably, the safety distance of the protective skirt from the shoulder is between 0.2 mm and 0.8 mm, even more preferably the safety distance is 0.5 mm Further features and advantages of the invention are more apparent in the non-limiting description which follows of a preferred non-exclusive embodiment of a dispenser for dispensing a fluid.

BRIEF DESCRIPTION OF THE DRAWINGS

The description is set out below with reference to the accompanying drawings which are provided solely for purposes of illustration without restricting the scope of the invention and in which:

FIGS. 5*a*-5*c* and 6*a*-6*d* are schematic views of a second embodiment of a first and a second component of the dispenser according to the invention.

DESCRIPTION OF THE PREFERRED EMBODIMENTS

With reference to the accompanying drawings, the numeral 1 denotes in its entirety a dispenser for dispensing a fluid which, for simplicity of description, will be referred to hereafter as the dispenser 1.

Figure 1:
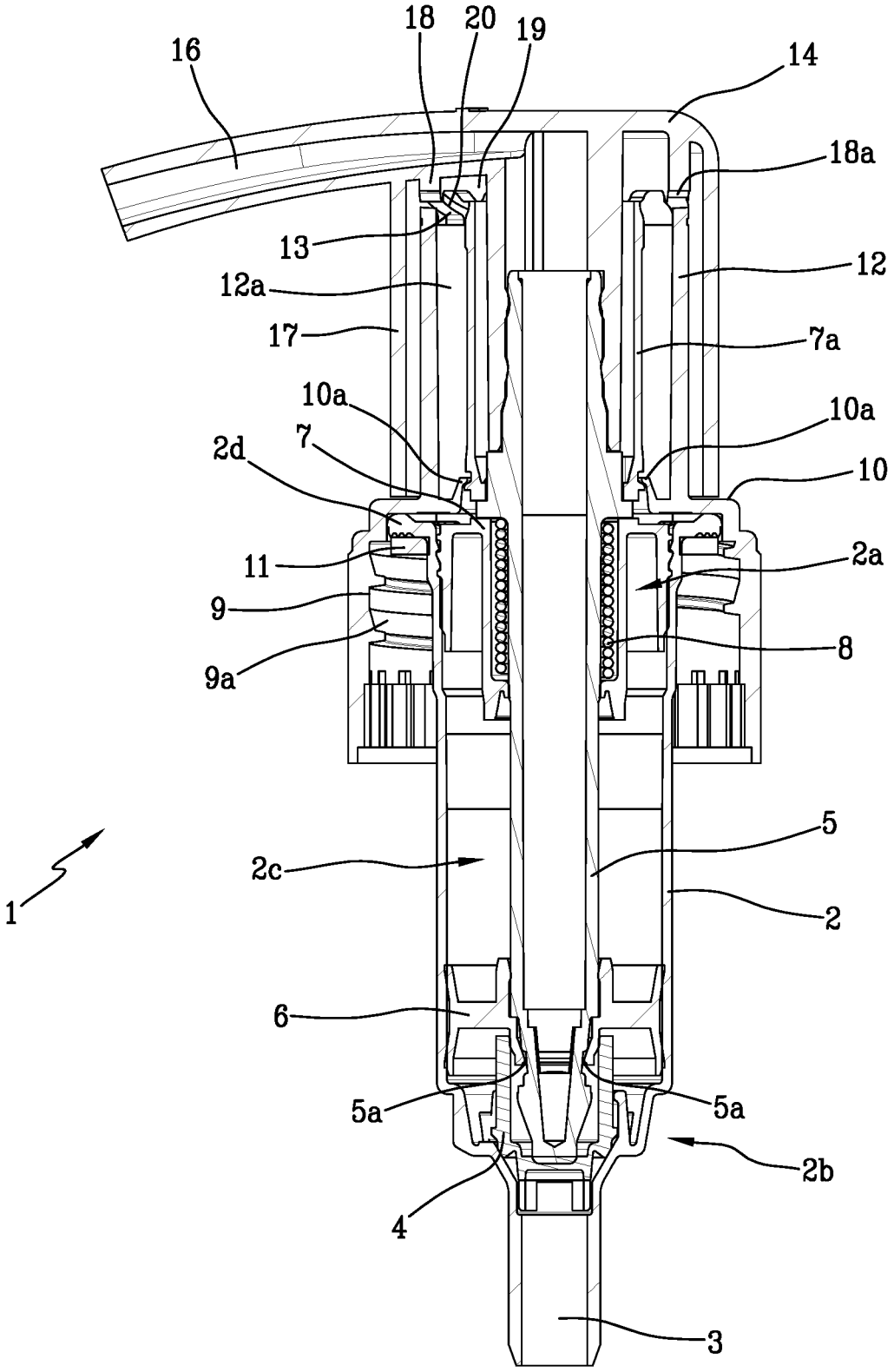
FIG. 1 is a schematic view of a dispenser according to the invention.

The dispenser 1 comprises a containment body 2 shown in FIG. 1. The containment body 2 is hollow and can be inserted in a bottle. The containment body 2 is preferably axisymmetric in shape and comprises a top portion 2*a* and a bottom portion 2*b*.

The top portion 2*a* of the containment body 2 is open and allows the components which make up the dispenser 1 to be inserted into the hollow body 2.

In the bottom portion 2*b*, the hollow body 2 comprises an orifice 3 for sucking fluid from the bottle. In other words, the liquid contained in the bottle enters the containment body 2 through the orifice 3.

In the bottom portion 2*b* a valve 4 is suitably located configured to open and close the orifice in a manner which will be described in more detail below.

The hollow body 2 also has a central portion 2*c* forming a dispensing chamber. Preferably, but not necessarily, the containment body 2 has a geometry which is substantially funnel-shaped.

The three portions 2*a*, 2*b* and 2*c* mentioned above preferably differ in terms of their transversal dimensions, so as to define the above-mentioned funnel-shaped configuration of the containment body 2.

The dispenser 1 also comprises a hollow stem 5 slidable axially inside the containment body 2 between a raised position and a lowered position. The lowered portion is shown in FIG. 1.

The hollow stem 5 is designed to transfer, through its cavity, the liquid present to the inside of the dispensing chamber. More specifically, the hollow stem comprises at least one window 5*a* (preferably it comprises two, even more preferably opposite to each other). The window 5*a* is configured to selectively place in fluid communication the cavity of the hollow stem 5 with the inside of the containment body 2, and in particular with the dispensing chamber of the central portion 2*c*. Preferably, but not necessarily, the window 5*a* (or the windows 5*a*) are made on the side wall of hollow stem 5.

Preferably, but not necessarily, the end portion of the hollow stem 5 is closed, so that the liquid in the dispensing chamber can enter the cavity of the stem only through the window 5*a*.

The dispenser 1 also comprises a piston 6 slidable inside the containment body 2 between a raised position and a lowered position (FIG. 1 shows the lowered position). The hollow stem 5 is in effect associated with the piston 6 and is configured for controlling the activation. In other words, the piston 6 is associated below to the hollow stem 5 which is configured to move the piston 6 inside the dispensing chamber defined in the central portion 2*c* of the containment body 2.

The piston 6 comprises an outer surface designed to come into contact with the inner wall of the dispensing chamber of the containment body 2.

The piston 6 slides between the above-mentioned raised position, in which the volume of the dispensing chamber is at its largest, and the above-mentioned lowered position, where the volume of the dispensing chamber is at its smallest.

The piston 6 slides with a fluid-tight seal along the inner wall of the containment body 2.

The hollow stem 5 is at least partly slidable relative to the piston 6 in such a way that the window 5*a* is occluded or released by the piston 6.

When the piston 6 creates an overpressure inside the dispensing chamber, the cavity of the hollow stem 5 is in fluid communication with the dispensing chamber and the fluid in the dispensing chamber rises along the hollow stem 5.

According to this configuration, the 4 valve is lowered and occludes the above-mentioned orifice 3 due to the overpressure in the dispensing chamber.

When the piston 6 creates a negative pressure inside the dispensing chamber, the cavity of the hollow stem 5 is not in fluid communication with the dispensing chamber and fluid is sucked into the dispensing chamber of the containment body 2 from the bottle.

In this configuration, the valve 4 rises, leaving the above-mentioned orifice 3 open, due to the negative pressure in the dispensing chamber.

According to the dispenser 1 described in the invention, the sliding of the piston 6 inside the containment body 2 occurs by opposing the action of a spring 8, housed inside a seat defined by the stem 5, which has the purpose of putting the piston 6 in the raised position.

The dispenser 1 also comprises a retaining ring 7 integral with the containment body 2 and inserted inside it. In particular, the retaining ring 7 is inserted in the top portion 2*a*.

The retaining ring 7 is configured for guiding the hollow stem 5 in its movement inside the containment body 2. In other words, the retaining ring is configured for guiding the hollow stem 5 between the raised position and the lowered position.

Preferably, but not necessarily, the retaining ring 7 has an upper portion 7*a* extending in elevation from a section for inserting the retaining ring 7 in the containment body 2. The upper portion 7*a* may be made in one piece with a main body of the retaining ring 7 or can be made by means of a pipe separate from the main body but associated with it.

Preferably, but not necessarily, the retaining ring 7 defines an upper limit of the dispensing chamber. This upper limit prevents the piston from coming out from the dispensing chamber of the containment body 2.

The dispenser 1 according to the invention also comprises a ring nut 9 which can be screwed on the neck of the bottle. The ring nut 9 shown in the accompanying drawings is, without limiting the scope of the invention, a screw connection, equipped with a respective thread 9*a* in such a way as to retain and constrain the containment body 2 inside the bottle.

Preferably, the ring nut 9 can be screwed to the bottle by mans of connecting means such as, for example, snap fitting means.

The ring nut 9 comprises a shoulder 10 which covers the containment body 2. In particular, the shoulder 10 is associated with, and covers, a lip 2*d* of the containment body 2. Preferably, but not necessarily, the lip 2*d* has an annular shape.

The lip 2*d* of the containment body 2 is located on the top portion 2*a* of the containment body 2 and surrounds an upper opening of it (where the retaining ring 7 is inserted).

Preferably, the shoulder 10 of the ring nut 9 is made in the form of a flange.

The shoulder 10 rests on a top surface of the lip 2*d* and compresses the same against the edge of the neck the bottle. In order to prevent the liquid present in the bottle from coming out accidentally, a sealing gasket 11 is located between the lip 2*d* and the edge of the bottle.

Preferably, but not necessarily, the shoulder 10 of the ring nut 9 is connected in a sealed fashion to the retaining ring 7 by a relative lip 10*a* which is preferably annular. Preferably, but not necessarily, the lip 10*a* is connected to the retaining ring 7 using the upper portion 7*a* of the retaining ring 7.

The ring nut 9 also comprises a collar 12 which extends in height from the shoulder.

Preferably, but not necessarily, the collar 12 may be made in one piece with the shoulder 10.

Alternatively, if the shoulder 10 is made in the form of a flange, the collar 12 is connected by means of the flange to a main body of the ring nut 9, equipped with connecting means such as, preferably, the thread 9*a*.

The collar 12 extends in such a way as to surround the upper portion 7*a* of the retaining ring 7. Preferably, the collar 12 extends for the full height of the upper portion 7*a* of the retaining ring 7 in such a way as to prevent the possible entrance of falling water inside the dispenser 1.

According to one aspect of the invention, the collar 12 comprises gripping elements 13 with a longitudinal extension. It should be noted the drawings indicate with the reference numeral 13 the gripping elements in their entirety, but the same reference numeral also indicates the single gripping element 13. The gripping elements 13 extend in length along a direction of extension of the collar 12 which rises from the shoulder 10. In other words, the gripping elements 13 extend longitudinally (according to a longitudinal direction of extension of the collar 12).

Preferably, the gripping elements 13 are located in an upper portion 12*a* of the collar 12. Preferably, but not necessarily, the gripping elements 13 define a discontinuous surface on the upper portion 12*a* of the collar 12.

The dispenser 1 also comprises a dispensing head 14 configured to control the operation of the hollow stem 5 and, therefore, of the piston 6. The dispensing head 14 comprises a central portion 15 connected to an upper portion of the hollow stem 5. The central portion 15 is put in fluid communication with the hollow stem 5 for dispensing the liquid contained in the bottle into the outside environment.

The dispensing head 14 also comprises a spout 16 designed to dispense the fluid contained in the bottle. In other words, the spout 16 is placed in fluid communication with the central portion 15 which is in turn in fluid communication with the hollow stem 5 in such a way as to dispense the fluid contained in the bottle when the dispensing head 14 is pressed by a user.

The dispensing head 14 also comprises a protective skirt 17 which extends in such a way as to contain the collar 12 of the ring nut 9. In particular, the protective skirt 17 has a predetermined distance from the collar 12 of the ring nut 9. The distance is such that the protective skirt does not directly surround the collar 12.

According to an advantageous aspect of the invention, the protective skirt 17 extends close to a peripheral portion of the shoulder 10. In particular, in a closed configuration of the dispenser 1 (shown in the accompanying drawings) wherein the dispensing of the fluid is prevented and wherein the dispenser 1 is advantageously suitable for transport, the protective skirt 17 has a safety distance 'G' from the shoulder 10.

Figure 4A:
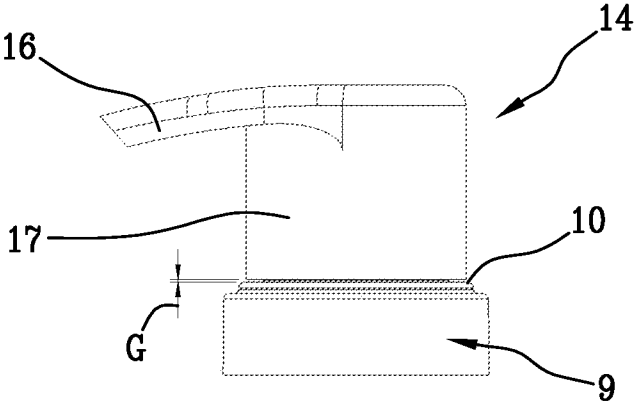
FIGS. 4*a* and 4*b* are schematic views of the first and second component of the dispenser according to a generic embodiment.
Figure 4B:
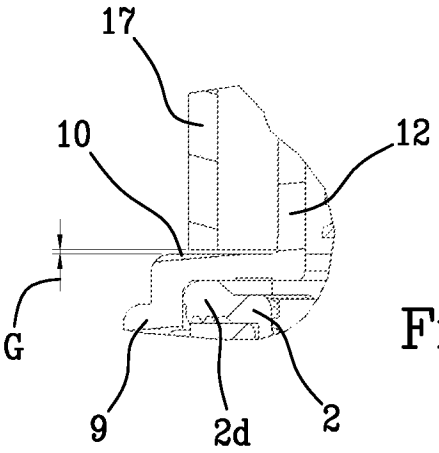

As shown in the accompanying drawings, and in particular in FIGS. 4*a* and 4*b*, the protective skirt 17 preferably has a diameter having dimensions close to the diameter of extension of the shoulder 10. Even more preferably, the diameter of the protective skirt 17 has an extension equal to that of the diameter of extension of the shoulder 10.

Preferably, the protective skirt 17 has a length such as to guarantee the safety distance 'G' in the closed configuration of the dispenser 1. In other words, the protective skirt 17 has a length such that it covers and surrounds completely, except the safety distance 'G', the collar 12 of the ring nut 9. In other words, the protective skirt 17 and the collar 12 can be superposed by reciprocal sliding (following activation of the dispenser 1 by pressure of the dispensing head 14 by a user).

Advantageously, the extension of the protective skirt 17 is such as to protect the internal parts of the dispenser 1 and to prevent the possible entrance of the water into the bottle containing the fluid to be dispensed both in the closed configuration suitable for transport and in the open configuration suitable for use of the dispenser 1.

Preferably, but not necessarily, the safety distance 'G' of the protective skirt 17 from the shoulder 10 is between 0.2 mm and 0.8 mm Even more preferably, the safety distance 'G' is of 0.5 mm.

Advantageously, the safety distance 'G' of the protective skirt 17 from the shoulder 10 enables, in the event of accidental collision of the dispenser 1 (in the case of falling of the dispenser from the package during transportation), an immediate contact of the protective skirt 17 with the shoulder 10 in such a way as to prevent excessive deformations of the ring nut 9 or other internal components of the dispenser 1 which might damage them.

In this way, the dispenser 1 is advantageously shock resistant to impacts in such a way that the force affects less the inner parts.

The dispensing head 14 also comprises a cylindrical ring 18 shaped according to a toothed profile 18*a*. The cylindrical crown 18 is located between the protective skirt 17 and the central portion 15.

According to an advantageous aspect of the invention, the toothed profile 18*a* is engaged with the gripping elements 13 in the closed configuration (which in the accompanying drawings is preferably, but without limiting the invention, illustrated with the lowered position of the dispensing head 14).

Preferably, the toothed profile 18 a has a predetermined number of teeth 19 and the collar 12 has a predetermined number of gripping elements 13 different from the number of teeth 19. The number of teeth 19 and the number of gripping elements 13 is such that at least one gripping element 13 is engaged with a tooth 19.

In other words, the number of teeth 19 and the number of gripping elements 13 are offset from each other in such a way as to modulate the intensity of the forces exchanged. Preferably, but not necessarily, the number of teeth 19 and the number of gripping elements 13 is such that they are not divisible by each other. In other words, a number of teeth 19 corresponds to a number of gripping elements 13 greater by at least one to the number of teeth 19 (or vice versa).

Preferably, but not necessarily, the toothed profile 18*a* has a number of teeth 19 alternated with as many recesses. Preferably, the recesses may have a horizontal profile, as preferably shown in the accompanying drawings.

Preferably, the teeth 19 are formed by two sections, each having a relative inclination. Preferably, but not necessarily, the inclination of each stretch is different in such a way as to obtain profiles which are not regular.

Figure 3B:
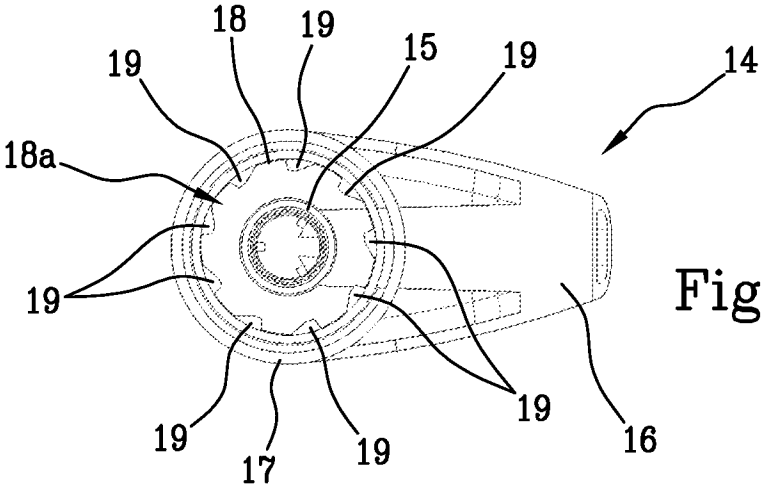
Figure 3A:
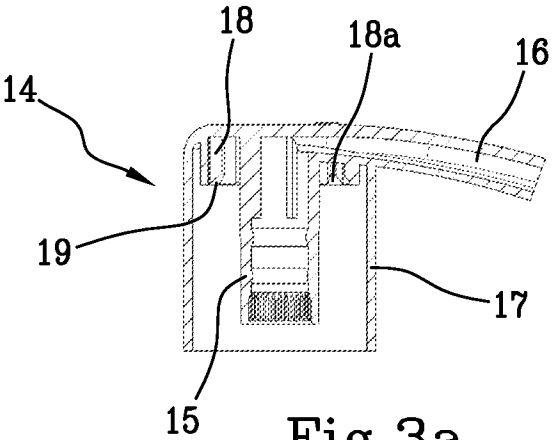
Figure 3C:
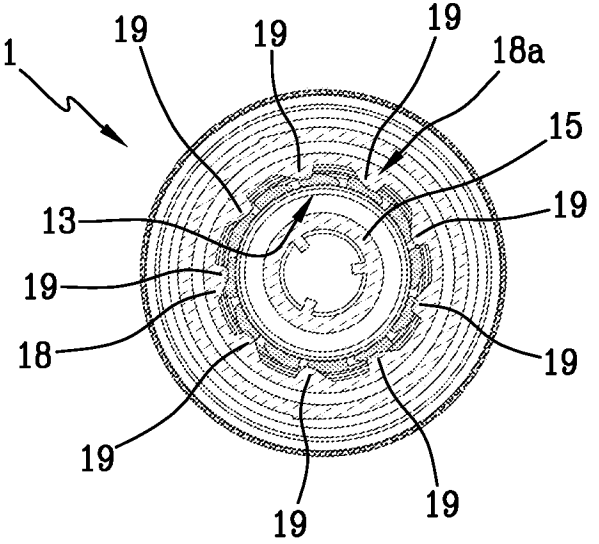
Figure 3D:
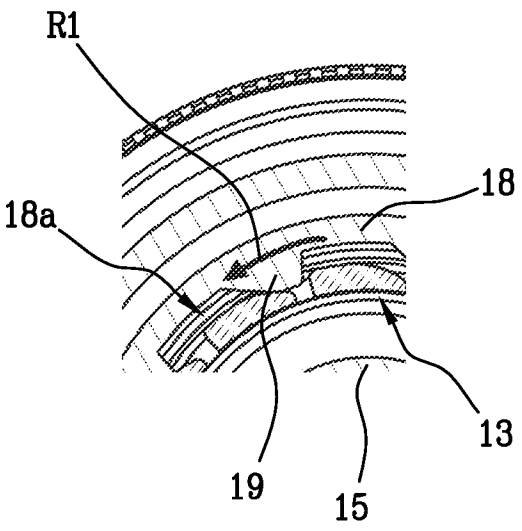

According to an advantageous aspect of the invention, the toothed profile 18*a* and the gripping elements 13 are shaped in such a way as to allow a facilitated reciprocal rotation of the dispensing head 14 and of the ring nut 9 along a closing direction 'R1' of the dispenser 1. FIG. 3*d* shows a rotation of the dispensing head 14 relative to the ring nut 9 along an anticlockwise closing direction 'R1'.

Figure 3E:
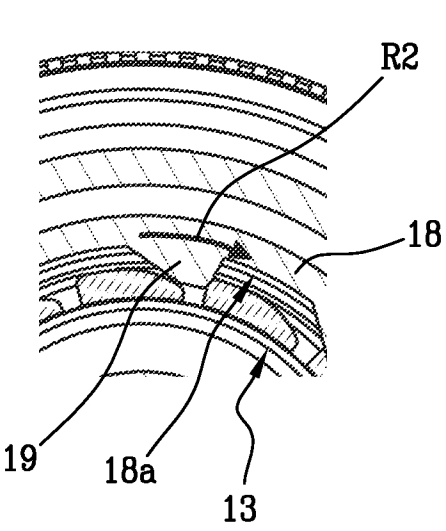

According to another advantageous aspect of the invention, the toothed profile 18*a* and the gripping elements 13 are shaped in such a way as to obstruct an accidental reciprocal rotation of the dispensing head 14 and of the ring nut 9 along an opening direction 'R2' of the dispenser 1. FIG. 3*e* shows a rotation of the dispensing head 14 relative to the ring nut 9 along a clockwise opening direction 'R2'.

Preferably, the closing 'R1' or opening 'R2' directions can be reversed (and the toothed profile 18*a* and the gripping elements 13 shaped consequently), but for simplicity of description they will be considered as illustrated in the accompanying drawings.

For example, the direction of closure 'R1' is represented in the anticlockwise direction but may also extend in a clockwise direction. Similarly, the direction of opening 'R2' is represented in a clockwise direction but may also extend in an anticlockwise direction.

In other words, the toothed profile 18*a* and the gripping elements 13 are shaped in such a way as to prevent accidental openings of the dispenser 1 when the latter is in the closed configuration. In this way, unless it is a user who wants to open the dispenser 1, the toothed profile 18*a* and gripping elements 13 guarantee that impacts caused by falling or other similar events cannot accidentally open the dispenser 1.

Preferably, the toothed profile 18*a* and the gripping elements 13 are shaped in such a way as to obtain angles of contact to allow the facilitated reciprocal rotation of the dispensing head 14 and of the ring nut 9 along the closing direction of the dispenser 1. The term 'angles of contact' is used to mean the angles with which the toothed profile 18*a* and the gripping elements 13 extend relative to a horizontal surface (for example, the recesses described above).

Advantageously, the geometry with which are made the gripping elements 13 and the toothed profile 18*a* is such that the torque needed to allow the reciprocal rotation between the dispensing head 14 and the ring nut 9 in the opening direction 'R2' is sufficiently high to prevent the accidental opening of the dispensing device 1.

Advantageously, the geometry with which are made the gripping elements 13 and the toothed profile 18*a* is such that the torque needed to allow the reciprocal rotation between the dispensing head 14 and the ring nut 9 in the closing direction 'R1' is sufficiently low to allow a sliding rotation. In this way it is possible to screw the dispenser 1 on the bottle easily whilst keeping the spout of the dispenser in a predetermined position.

Figure 2C:
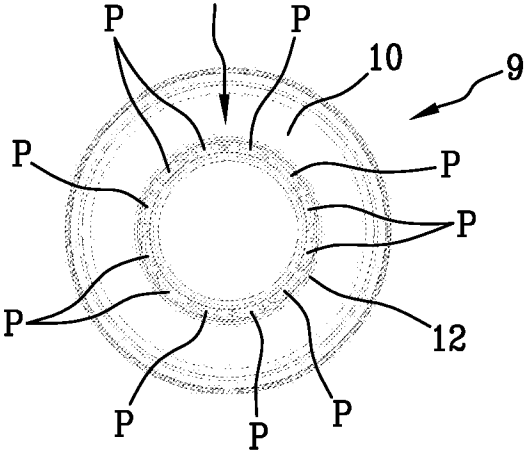
FIGS. 2*a* to 2*c* and 3*a*-3*e* are schematic views of, respectively, a first embodiment of a first and a second component of the dispenser according to the invention.
Figure 2B:
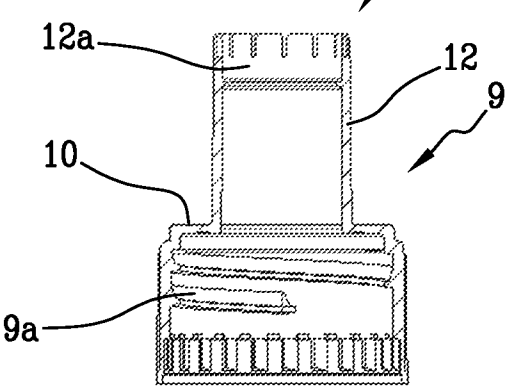
Figure 2A:
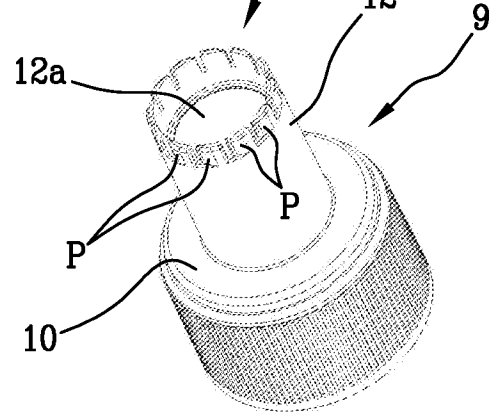

According to a first preferred, but non-limiting, embodiment of the invention, the gripping elements 13 are shaped with an asymmetrical profile 'P' with a variable inclination, as shown in FIGS. 2*a*-2*c*. The asymmetrical profile 'P' is defined in a portion facing towards the toothed profile 18*a*.

Preferably, but not necessarily, the teeth 19 of the toothed profile 18*a* are shaped with two stretches having angles of inclination such as to define a saw tooth profile, as shown in the accompanying drawings.

Preferably, but not necessarily, the toothed profile 18*a* is directed towards the central portion 15 of the dispensing head 14. In other words, the toothed profile 18*a* has teeth 19 which extend towards the central portion 15 of the dispensing head 14 as shown in FIGS. 3*a*-3*e*.

In other words, the asymmetrical profile 'P' extends away from the central portion 15 of the dispensing head 14, in such a way as to engage with the teeth 19 of the toothed profile 18*a*.

In light of this, the collar 12 has a diameter slightly less than the diameter of the cylindrical crown 18 defined by a toothed profile 18*a* in such a way as to allow the engagement between the asymmetrical profile 'P' of the gripping elements 13 and the teeth 19.

Preferably, other configurations are possible, such as, for example, a toothed profile 18*a* oriented towards the bottle and gripping elements with an asymmetrical profile 'P' extending away from the upper portion 12*a* of the collar 12. In this case, the collar 12 requires a diameter greater than that of the collar 12 described above.

Preferably, the asymmetrical profile 'P' shown in the accompanying drawings has at least two sections with variable inclination in such a way as to operate in combination with the teeth 19 of the toothed profile 18*a*.

This configuration of the teeth 19 and of the gripping elements 13 is such that a radial component of the reciprocal force of contact is preponderant during the reciprocal rotation of the dispensing head 14 and of the ring nut 9 in the closing direction 'R1'.

Alternatively, this configuration of the teeth 19 and of the gripping elements 13 is such that, during the reciprocal rotation in the opening direction of 'R2', a tangential component of the contact force prevails which determines the need for a high torque (which can be applied by a user) to obtain the opening of the dispenser 1.

The asymmetrical profile 'P' also allows to gripping elements 13 to be obtained which are sufficiently flexible in the radial direction.

Preferably, but not necessarily, the teeth 19 illustrated in the accompanying drawings, have a bevelling in their lower portion facing towards the bottle.

Similarly, the asymmetrical profile 'P', shown in the accompanying drawings, is rounded in its upper edge. In this way it is possible to avoid collisions during the assembly step between the gripping elements 13 and the teeth 19 which would be superposed because in phase with each other.

FIGS. 5*a*-5*c* and FIGS. 6*a*-6*d* shows a second preferred (non-limiting) embodiment of the invention. Preferably, according to said embodiment, the diameter with which the collar 12 is defined is greater than that of the previous embodiment in such a way that the gripping elements 13 can work with the toothed profile 18*a* made on the cylindrical crown 18.

According to said second embodiment, the gripping elements 13 are made in the form of tabs 20. The accompanying drawings illustrate four tabs positioned symmetrically with respect to each other. Preferably, other embodiments are possible provided the phase displacement is maintained between the gripping elements 13 and the teeth 19.

Preferably, the tabs 20 define, with a horizontal edge of the upper portion 12*a* of the collar, an acute angle as shown in the accompanying drawings. In other words, the tabs 20 extend according to the longitudinal direction of extension of the collar 12, with an angle greater than 0° and less than 90°.

Preferably, the toothed profile 18*a* has teeth 19 directed towards a lower portion of the dispensing head 14. In other words, the teeth 19 are directed towards the bottle containing the fluid.

In this way, a tooth 19 slides on a respective tab 20 in such a way as to allow the facilitated reciprocal rotation of the dispensing head 14 and of the ring nut 9 along the closing direction 'R1' of the dispenser 1.

Moreover, this configuration allows the tooth 19 to be locked by a respective tab 20 in such a way as to obstruct any accidental reciprocal rotation of the dispensing head 14 and of the ring nut 9 along the opening direction 'R2' of the dispenser 1.

In other words, the tabs 20 engage against a lower profile of the cylindrical crown 18 suitably shaped with a sequence of protruding teeth spaced by the same number of recesses.

In the event of accidental reciprocal rotation between the dispensing head 14 and the ring nut 9 in the opening direction 'R2' of the dispenser 1, the resultant 'R' between the contact forces exchanged between the teeth 19 and the tabs 20 is directed almost like the respective tongue 20, which therefore better withstands the deformation (FIG. 6*c*).

In the case of reciprocal rotation between the dispensing head 14 and the ring nut 9 in the closing direction 'R1' of the dispenser 1, the resultant 'R' between the contact forces exchanged between the teeth 19 and the tabs 20 is directed transversely with respect to the respective tab 20 (FIG. 6*d*). In this way, the tab 20 bends allowing the passage of the tooth 19.

The embodiments of the dispenser 1 described above are particularly advantageous for a dispenser 1 of the 'lock-down' type such as that shown in the accompanying drawings.

Advantageously, the dispenser 1 is able to overcome the drawbacks of the prior art.

Advantageously, the coupling between the gripping elements 13 and the toothed profile 18*a* in the closed configuration considerably reduces the risk of accidental opening of the dispenser 1.

Advantageously, the protective skirt 17 allows a greater protection of the internal components of the dispenser 1 and in particular the gripping elements 13 and the toothed profile 18*a*.

Advantageously, the dispenser 1 described above has a high degree of resistance to impacts and/or flattening during the step of transporting to a final user.

Advantageously, the dispenser 1 described above, even if it is poorly packaged, is able to resist impacts which would cause the accidental opening of a dispenser of the prior art type.

The invention claimed is:

1. A dispenser (1) for dispensing a fluid comprising:

a hollow containment body (2) which can be inserted in a bottle and comprising an orifice (3) for sucking fluid from said bottle;

a ring nut (9) which can be screwed on the neck of said bottle and comprising a shoulder (10), covering and associated with a lip (2*d*) of the containment body (2), and a collar (12) extending in elevation from the shoulder (10);

a piston (6) slidable inside said containment body (2) between a raised position and a lowered position;

a hollow stem (5) axially slidable inside said containment body (2) and associated below to the piston (6);

a dispensing head (14) comprising a central portion (15) connected to an upper portion of said hollow stem (5) to actuate the piston (6), a spout (16) designed to dispense the fluid contained in the bottle and a protective skirt (17) extending in such a way as to contain the collar (12) of said ring nut (9);

a retaining ring (7) integral with the containment body (2) and inserted inside the containment body for guiding the hollow stem (5) in the hollow stem's stroke inside the containment body (2);

wherein said dispensing head (14) comprises a cylindrical crown (18) shaped to form a toothed profile (18*a*) and located between the protective skirt (17) and the central portion (15);

said collar (12) of said ring nut (9) comprises gripping elements (13) with a longitudinal extension; the toothed profile (18*a*) being engaged with said gripping elements (13) in a configuration for closing the dispenser (1) in which the dispensing of the fluid is prevented;

wherein said toothed profile (18*a*) and said gripping elements (13) are shaped in such a way as to allow a facilitated reciprocal rotation of said dispensing head (14) and the ring nut (9) along a direction (R1) for closing the dispenser (1) and obstruct an accidental reciprocal rotation of the dispensing head (14) and the ring nut (9) along a direction (R2) for opening the dispenser (1).

2. The dispenser (1) according to claim 1, wherein said toothed profile (18*a*) has a predetermined number of teeth (19) and wherein the collar (12) has a predetermined number of gripping elements (13) which is different from the number of teeth (19) and such that at least one gripping element (13) is engaged with a tooth (19).

3. The dispenser (1) according to claim 2, wherein said toothed profile (18*a*) and said gripping elements (13) are shaped in such a way as to obtain angles of contact to allow said facilitated reciprocal rotation of the dispensing head (14) and the ring nut (9) along the direction (R1) for closing the dispenser (1).

4. The dispenser (1) according to claim 2, wherein said toothed profile (18*a*) has a predetermined number of teeth (19) alternated with as many recesses, the predetermined number of teeth (19) being offset relative to a predetermined number of gripping elements (13).

5. The dispenser (1) according to claim 1, wherein said toothed profile (18*a*) and said gripping elements (13) are shaped in such a way as to obtain angles of contact that allow said facilitated reciprocal rotation of the dispensing head (14) and the ring nut (9) along the direction (R1) for closing the dispenser (1).

6. The dispenser (1) according to claim 5, wherein said toothed profile (18*a*) has a predetermined number of teeth (19) alternated with as many recesses, the predetermined number of teeth (19) being offset relative to a predetermined number of gripping elements (13).

7. The dispenser (1) according to claim 1, wherein said toothed profile (18*a*) has a predetermined number of teeth (19) alternated with as many recesses, the predetermined number of teeth (19) being offset relative to a predetermined number of gripping elements (13).

8. The dispenser (1) according to claim 7, wherein said teeth (19) are defined by two sections, each having a relative inclination.

9. The dispenser (1) according to claim 1, wherein said gripping elements (13) are located in an upper portion (12*a*) of said collar (12) and form a discontinuous surface.

10. The dispenser (1) according to claim 1, wherein said gripping elements (13) are shaped, in a portion facing towards said toothed profile (18*a*), with an asymmetrical profile (P) with a variable inclination.

11. The dispenser (1) according to claim 10, wherein said toothed profile (18*a*) is facing towards said central portion (15) of the dispensing head (14).

12. The dispenser (1) according to claim 10, wherein said toothed profile (18*a*) has teeth (19) bevelled in a lower portion of them and wherein said gripping elements (13) have a rounding in an upper portion facing towards the toothed profile (18*a*).

13. The dispenser (1) according to claim 1, wherein said gripping elements (13) are made in the form of tabs (20).

14. The dispenser (1) according to claim 13, wherein said tabs (20) define, with a horizontal edge of an upper portion (12*a*) of said collar (12), an acute angle greater than 0° and less than 90°.

15. The dispenser (1) according to claim 13, wherein said toothed profile (18*a*) has teeth (19) facing towards a lower portion of said dispensing head (14) in such a way that a tooth (19) slides on a respective tab (20), in such a way as to allow the facilitated reciprocal rotation of the dispensing head (14) and the ring nut (9) along the closing direction (R1), or which is locked by a respective tab (20) in such a way as to obstruct the accidental reciprocal rotation of the dispensing head (14) and the ring nut along the direction (R2) of opening the dispenser (1).

16. The dispenser (1) according to claim 1, wherein said protective skirt (17) extends close to a peripheral portion of said shoulder (10) and, in the closed configuration of the dispenser (1), has a safety distance (G) from the shoulder (10).

17. The dispenser (1) according to claim 16, wherein said protective skirt (17) has a length that guarantees the safety distance (G) in the closed configuration of said dispenser (1).

18. The dispenser (1) according to claim 16, wherein said safety distance (G) of the protective skirt (17) from said shoulder is between 0.2 mm and 0.8 mm.

19. The dispenser (1) according to claim 16, wherein said safety distance (G) of the protective skirt (17) from said shoulder is 0.5 mm.

20. The dispenser (1) according to claim 1, wherein said protective skirt (17) has a diameter having dimensions close to a diameter of extension of said shoulder (10).

* * * * *